United States Patent [19]

Herbots et al.

[11] Patent Number: 4,561,991

[45] Date of Patent: Dec. 31, 1985

[54] FABRIC CLEANING COMPOSITIONS FOR CLAY-BASED STAINS

[75] Inventors: Ivan Herbots, Wetteren; James P. Johnston, Overijse; John R. Walker, Waterloo, all of Belgium

[73] Assignee: The Procter & Gamble Company, Cincinnati, Ohio

[21] Appl. No.: 638,097

[22] Filed: Aug. 6, 1984

[51] Int. Cl.[4] ..... C11D 9/30; C11D 15/04; C11B 11/00; D01C 3/00

[52] U.S. Cl. ..... 252/118; 252/153; 252/170; 252/171; 252/547; 252/548; 252/DIG. 14; 252/DIG. 19; 8/139.1

[58] Field of Search ..... 252/102, 111, 127, 104, 252/103, 170, 158, 139, 143, 523, 525, 529, 541, 544, 548, 547, DIG. 2, 15, 174.21, 174.23; 8/139.1

[56] References Cited

U.S. PATENT DOCUMENTS

| | | | |
|---|---|---|---|
| 2,073,464 | 3/1937 | Davey | 252/122 |
| 3,354,093 | 11/1967 | Early et al. | 252/170 |
| 3,650,968 | 3/1972 | Hoffman et al. | 252/142 |
| 3,658,708 | 4/1972 | Ratto | 252/56 R |
| 4,414,128 | 11/1983 | Goffinet | 252/111 |
| 4,438,009 | 3/1984 | Bruskey et al. | 252/90 |

FOREIGN PATENT DOCUMENTS

| | | |
|---|---|---|
| 1603047 | 5/1978 | United Kingdom . |
| 2010892 | 12/1978 | United Kingdom . |
| 2022126 | 6/1979 | United Kingdom . |

OTHER PUBLICATIONS

Davidsohn, 3rd International Congress of Surface Activity, Cologne, (1960), Soap Perfumery Cosmetics, Apr. 1983, pp. 174, 175.

*Primary Examiner*—Paul Lieberman
*Assistant Examiner*—John F. McNally
*Attorney, Agent, or Firm*—Richard C. Witte; Jerry J. Yetter; Jacobus C. Rasser

[57] ABSTRACT

Stain removal composition comprise mixtures of grease-cutting solvents and polyamines. The compositions are particularly useful for removing stains comprising a mixture of grease and particulate matter from fabrics. Liquid detergents containing said solvents and polyamines in the form of stable oil-in-water microemulsions are disclosed.

11 Claims, No Drawings

FABRIC CLEANING COMPOSITIONS FOR CLAY-BASED STAINS

TECHNICAL FIELD

The present invention relates to compositions and processes for removing clay-based soils and stains from fabrics. The compositions are particularly adapted for removing cosmetic stains, which comprises a mixture of clay-based material and an oily or greasy binder material. Compositions which comprise a solvent ingredient to disperse the binder and a polyamine material to disperse the clay are provided. These compositions can be used in the form of a simple fabric pre-spotter, or in fully-formulated laundry detergents comprising a mixture of various ingredients designed to remove a broad spectrum of stains and soils from fabrics, with particularly noteworthy benefits on stains caused by cosmetics.

BACKGROUND

Detergent formulators are faced with the task of devising products to remove a broad spectrum of soils and stains from fabrics. Chemically and physico-chemically, the varieties of soils and stains range the spectrum from primarily oily, through proteinaceous and carbohydrate, to inorganic, and detergent compositions have become more complex as formulators attempt to provide products which handle all types, concurrently. For example, protease enzymes are commonly used in detergents for blood and gravy stains; amylase enzymes are used for carbohydrate stains; nonionic surfactants are used for hydrocarbon oils; and anionic surfactants and builders are used for particulate soil. Bleach is used to chemically degrade stains that are not amenable to removal by less rigorous treatment.

One of the most difficult stains to remove from fabrics is the cosmetic stain, and from time immemorial the persistent, telltale smudge of lipstick on a shirtcollar or handkerchief has been the downfall of many a miscreant. Moreover, the remarkable ability of the modern cosmetic industry to provide products which are more and more long-lasting on the user's skin necessarily means that today's cosmetics are increasingly persistent on fabrics to which they are unintentionally applied.

Chemically, many cosmetics comprise a clay base which serves in part as a filler, thickener, carrier for color bodies, and the like, blended with an oily material which serves partially as a binder, gloss agent and emollient. Cosmetics are typically manufactured with great care, such that the clay and color bodies are in the form of very fine particles, and are very thoroughly and completely mixed with, and coated by, the oily material, which may be a hydrocarbon oil, silicone, lipid, or complex mixtures thereof. While optimal from the standpoint of the cosmetic formulator, the modern cosmetic product causes major problems for the detergent formulator, since cosmetics constitute a mix of widely divergent soil types (oily, particulate, clay) all in intimate admixture and often brightly colored. No single detergent ingredient can reasonably be expected to handle such a complex milieu.

The present invention employs oil-removal solvents and clay-removal polyamines. The solvents dissolve the oil base of the cosmetics, thereby exposing their clay component to the polyamine materials which disperse and remove it from fabrics.

The use of solvents of the type employed in this invention as grease and oil removal ingredients in cleaners of various types is well-known commercially and from the patent literature. See, for example, U.S. Pat. No. 2.073.464; EPO Application Nos. 0 072 488 and 81200540.3; and British Pat. No. 1.603.047.

However, the use of such solvents in combination with polyamine materials in the manner disclosed herein is not believed to have been contemplated, heretofore.

SUMMARY OF THE INVENTION

The present invention relates to compositions and processes for removing cosmetic stains, and the like, from fabrics, by means of a solvent (especially solvents such as isoparaffinic hydrocarbons, kerosene, petroleum fractions, d-limonene or mixed terpenes, fatty alcohols, benzyl alcohol and mixtures thereof) and an alkoxylated polyamine (as described more fully hereinafter) at a weight ratio of solvent:polyamine of 100:1 to 1:20, preferably at least 2:1. The invention also encompasses fully-formulated detergent compositions which comprise conventional detergency ingredients such as detergency builders, enzymes, detersive surfactants, and the like, characterized in that such compositions contain at least about 5% by weight of the aforesaid mixture of solvent and polyamine. Preferably, such fully-formulated detergent compositions contain at least 5% of the solvent and at least 0.2% of the polyamine.

DETAILED DESCRIPTION OF THE INVENTION

The essential solvent and polyamine components, as well as the preferred surfactant components and other optional ingredients used in the practice of the present invention are described in more detail, hereinafter. All percentages and ratios mentioned in this specification are by weight, unless otherwise stated.

Solvent—The solvents employed herein can be any of the well-known "degreasing" solvents commonly known for use in, for example, the commercial laundry and drycleaning industry, in the hard-surface cleaner industry and the metalworking industry. Typically, such solvents comprise hydrocarbon or halogenated hydrocarbon moieties of the alkyl or cycloalkyl type, and have a boiling point well above room temperature.

The formulator of compositions of the present type will be guided in the selection of solvent partly by the need to provide good grease-cutting properties, and partly by aesthetic considerations. For example, kerosene hydrocarbons function quite well in the present compositions, but can be malodorous. Kerosene can be used in commercial laundries. For home use, where malodors would not be tolerated, the formulator would be more likely to select solvents which have a relatively pleasant odor, or odors which can be reasonably modified by perfuming. Such solvents include, for example, the terpenes and terpenoid solvents obtainable from citrus fruits, especially orange terpenes and d-limonene. Benzyl alcohol is another relatively pleasant smelling solvent for use herein.

Excellent solvents for use herein are paraffins and the mono- and bicyclic mono-terpenes, i.e., those of the hydrocarbon class, which include, for example, the terpinenes, limonenes and pinenes, and mixtures thereof. Highly preferred materials of this type are d-limonene and the mixture of terpene hydrocarbons obtained from the essence of oranges, (e.g. cold-pressed orange terpenes and orange terpene oil phase ex fruit juice). Also useful are, for example, terpenes such as dipentene, alpha-pinene, beta-pinene and the mixture of terpene hydrocarbons expressed from lemons and grapefruit.

The examples disclosed hereinafter describe various other solvents which can be used herein.

Polyamines—It is to be understood that the term "polyamines" as used herein represents generically the alkoxylated polyamines, both in their amine form and in their quaternized form. Such materials can conveniently be represented as molecules of the empirical structures with repeating units:

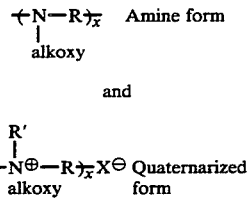

Amine form and

Quaternarized form wherein R is a hydrocarbyl group, usually of 2–6 carbon atoms; R′ may be a $C_1$–$C_{20}$ hydrocarbon; the alkoxy groups are polyethoxy, polypropoxy, and the like, with polyethoxy having a degree of polymerization of 2–30, most preferably, 10 to 20; x is an integer of at least 2, preferably from 2–20, most preferably 3–5; and $X^{\ominus}$ is an anion such as halide or methylsulfate, resulting from the quaternization reaction.

The most highly preferred polyamines for use herein are the so-called ethoxylated polyethylene imines, i.e., the polymerized reaction product of ethylene oxide with ethylene-imine, having the general formula:

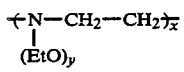

wherein x is an integer of 3 to 5 and y is an integer of 10 to 20.

Surfactants—In addition to the solvent and polyamine, it is optional, but highly preferred, that the compositions herein contain organic surface-active agents ("surfactants") to provide the usual cleaning benefits associated with the use of such materials.

Water-soluble detersive surfactants useful herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, β-sulfonates of fatty acids and of fatty acid esters, and the like, which are well-known from the detergency art. In general, such detersive surfactants contain an alkyl group in the $C_9$–$C_{18}$ range; the anionic detersive surfactants are most commonly used in the form of their sodium, potassium or triethanolammonium salts; the nonionics generally contain from about 5 to about 17 ethylene oxide groups. U.S. Pat. Nos. 4.111.855 and 3.995.669 contain detailed listings of such typical detersive surfactants. $C_{11}$–$C_{16}$ alkyl benzene sulfonates, $C_{12}$–$C_{16}$ alkyl sulfates, and the ethoxylated alcohols and alkyl phenols are especially preferred in the compositions of the present type.

The surfactant component can comprise as little as 1% of the compositions herein, but preferably the compositions will contain 1% to 40%, preferably 5% to 30%, of surfactant. Mixtures of the ethoxylated nonionics with anionics such as the alkyl benzene sulfonates, alkyl sulfonates and paraffin sulfonates are preferred for through-the-wash cleansing of a broad spectrum of soils and stains from fabrics.

Fatty Acid/Soap Ingredient—Fatty acids (generally $C_{10}$–$C_{18}$ chain length) and their water-soluble salts (i.e., common "soaps", especially alkali metal soaps) can be used in the present compositions not only for their detersive-surfactant properties, but also to provide an additional detergency builder function by virtue of their ability to interact with water hardness cations. As will be described more fully hereinafter, fatty acids and soaps are particularly useful when preparing fully-formulated, homogeneous oil-in-water liquid detergents comprising the solvent and polyamine in an aqueous carrier. Usage levels of 0.5–50% are typical.

Other Optional Ingredients—The compositions herein can contain other ingredients which aid in their cleaning performance. For example, it is highly preferred that through-the-wash detergent compositions contain a detergent builder and/or metal ion sequestrant. Compounds classifiable and well-known in the art as detergent builders include the nitrilotriacetates, polycarboxylates, citrates, water-soluble phosphates such as tri-polyphosphate and sodium ortho- and pyro-phosphates, silicates, and mixtures thereof. Metal ion sequestrants include all of the above, plus materials like ethylenediaminetetraacetate, and amino-polyphosphonates and phosphates (DEQUEST) and a wide variety of other poly-functional organic acids and salts too numerous to mention in detail here. See U.S. Pat. No. 3.579.454 for typical examples of the use of such materials in various cleaning compositions. In general, the builder/sequestrant will comprise about 0.5% to 15% of the composition. Citrate is one of the most preferred builders since it is readily soluble in the aqueous phase of heavy-duty liquid detergent compositions.

The compositions herein also preferably contain enzymes to enhance their through-the-wash cleaning performance on a variety of soils and stains. Amylase and protease enzymes suitable for use in detergents are well-known in the art and in commercially available liquid and granular detergents. Commercial detersive enzymes (preferably a mixture of amylase and protease) are typically used at levels of 0.001% to 2%, and higher, in the present compositions. Ingredients such as propane diol and/or formate and calcium can be added to help stabilize the enzymes in well-known fashion, according to the desires of the formulator.

Moreover, the compositions herein can contain, in addition to ingredients already mentioned, various other optional ingredients typically used in commercial products to provide aesthetic or additional product performance benefits. Typical ingredients include pH regulants, perfumes, dyes, optical brighteners, soil suspending agents, hydrotropes and gel-control agents, freeze-thaw stabilizers, bactericides, preservatives, suds control agents and the like.

Water-alcohol (e.g., ethanol, isopropanol, etc.) mixtures can be used as the carrier vehicle in liquid compositions, and alkylated polysaccharides can be used to increase the stability and performance characteristics of the compositions.

The compositions herein are preferably formulated in the neutral to alkaline pH range, generally in the range of pH 6.5–9.0, preferably about 6.8–7.5. Materials such as sodium hydroxide, potassium hydroxide, the alkanol amines such as triethanol-amines, or magnesium hydroxide, can be used to adjust the pH, as desired. Preferred pH adjusting agents are described hereinafter.

The preferred compositions herein are in liquid form, which can be prepared by simply blending the essential and optional ingredients in a fluid (preferably aqueous) carrier. As mentioned hereinabove, fatty acid or soap can be used in such liquid compositions to provide clear, homogeneous microemulsions of the solvent in an aqueous carrier. Solid or granular compositions can be prepared by adsorbing the solvent and polyamine in a suitable granular carrier, for example, in a sodium sulfate, sodium perborate (bleach) or spray-dried detergent granule carrier.

In one process aspect, the compositions herein in the form of liquids or pastes can be used to pre-treat soiled fabrics by rubbing a few milliliters of the composition directly onto and into the soiled area, followed by laundering, in standard fashion. In a through-the-wash mode, the compositions are typically used at a concentration of at least 500 ppm, preferably 0.1% to 1.5% in an aqueous laundry bath at pH 6.5–10 to launder fabrics. The laundering can be carried out over the range from 5° C. to the boil, with excellent results.

INDUSTRIAL APPLICATION

The following examples describe a variety of formulations which can be prepared in the manner of the present invention using the mixed solvent/polyamine ingredients. The examples are given by way of illustration and are not intended to be limiting of the scope of the invention. In the formulations listed, the terms "x" and "y" are stated in parentheses to designate the degree of polymerization and degree of alkoxylation of the polyamine. For some "polyamines", the designation R′ is also included, thereby denoting a quaternized polyamine. For such quaternized materials, the resulting anion $X^{\ominus}$ is of no consequence to cleaning performance, and is not designated. In all examples, R is $—CH_2—CH_2—$ and alkoxyl is ethoxyl, unless otherwise specified.

EXAMPLE I

Following the teachings of U.S. Pat. No. 3,664,962, a spot remover in stick form is prepared by blending the following ingredients, extruding the resulting mass through a 1.25cm die, and packaging the resulting stick in an aluminum foil wrapper.

| Ingredient | Percent |
|---|---|
| Sodium stearate | 22.0 |
| d-Limonene | 15.0 |
| Benzyl alcohol | 8.0 |
| 2-Propanol | 22.0 |
| Polyamine (x = 2; y = 6 avg.) | 10.0 |
| Sodium dodecyl benzene sulfonate | 3.5 |
| Water | to 100 |

In use, the foil wrapper is peeled away from a portion of the stick, which is then rubbed briskly onto the area of a garment soiled with cosmetic, or the like, stains. The garment is thereafter brushed, or optionally laundered, to remove the stain, together with residues from the stick.

EXAMPLE II

A liquid fabric pre-treatment and through-the-wash detergency booster is prepared by blending the following ingredients.

| Ingredient | Parts by Weight |
|---|---|
| Paraffin oil (deodorized) | 20 |
| Polyamine (x = 3; y = 15 avg.) | 7 |
| Water | 50 |
| Ethoxylated sorbitan oleate | 3 |

In a preferred method of use, a few (1–10) milliliters of the composition of Example II are applied directly to an area of fabric stained with clay/grease soil and rubbed briskly into the stained area. The fabric is thereafter laundered with a commercial laundry detergent (e.g., VIZIR) according to label instructions.

In an alternative mode, the composition of Example II is added directly to an aqueous laundry bath, generally at a level of 500–5000 ppm, depending on the desires of the user and the soil load, together with a commercial laundry detergent, to enhance cleaning performance.

The composition of Example II can be diluted (1:1) with water or water-ethanol and packaged in an aerosol or manual pump dispenser for use as a spot remover.

EXAMPLE III

A granular detergent composition comprising the solvent/polyamine compositions of the present invention can be prepared by blending the solvent/polyamine with a spray-dried commercial laundry detergent. However, in a preferred mode, the solvent/polyamine is admixed with non-neutralized anionic surfactant, which is then admixed with alkaline detergency builder and other optional detergency ingredients, whereby the surfactant is neutralized in situ in the product. This method of formulating solvent-containing granular detergents is described by A. Davidsohn in the report of the original lectures, 3rd *International Congress of Surface Activity Cologne,* pages 165 to 172 at 171 (1960).

Following the operating procedures suggested by Davidsohn, there is prepared a granular detergent of the formulation:

| Ingredient | Percent |
|---|---|
| $C_{12}$ (avg.) alkyl benzene sulfonate | 9.6 (acid form) |
| $C_{12-15}$ alkyl ethoxylate (EO avg. 9) | 1.4 |
| Sodium perborate. $4H_2O$ | 22.0 |
| Sodium tripolyphosphate | 19.0 |
| Orange terpene | 10.0 |
| Polyamine (x = 3; y = 16) | 1.0 |
| Sodium sulfate | 20.0 |
| $C_{16}$–$C_{18}$ hardened soap (suds control) | 1.5 |
| Enzymes (protease/amylase mix) | 1.5 |
| Carboxymethyl cellulose | 2.0 |
| Water, optical brightener, minors | to 100 |

The composition of Example III is used in standard fashion to launder fabrics. In a preferred mode, ca. 2 g. of the composition is admixed with ca. 5 ml. water to form a paste which is then rubbed into heavily soiled areas of fabrics, prior to laundering with the composition.

EXAMPLES IV–IX

The following examples relate to compositions within the scope of this invention with solvents which are particularly suitable in industrial, heavy-duty laundry and cleaning plants, and the like. It will be appreciated by the formulator that some of the solvents employed in such compositions may be unsuitable for general home use, due to malodors, potential for skin irritation, low flash points, and the like. However, such compositions are entirely suitable for use under properly controlled conditions by professional operators who take such matters into consideration. In Examples IV–IX, all ingredients are listed as parts by weight.

| INGREDIENT | IV | V | VI | VII | VIII | IX |
|---|---|---|---|---|---|---|
| Stoddard solvent | 100 | — | — | — | — | 250 |
| Trichloro-ethylene | — | 10 | — | — | — | — |
| Naphtha | — | — | 30 | — | — | — |
| Petroleum Ether (b.p. 80–85° C.) | — | — | — | 60 | 100 | — |
| Mineral spirits | — | — | — | 20 | — | — |
| Benzyl alcohol | — | — | — | — | 100 | — |
| Butyl carbitol (T.M.) | — | — | — | — | — | 50 |
| Polyamine (A–F*) | 5(A) | 10(B) | 15(C) | 100(D) | 20(E) | 150(F) |
| Water | 100 | 100 | 200 | — | 250 | 350 |
| Coconut soap | — | — | 25 | — | — | — |
| $C_{12}$ alkyl benzene sulfonate | 50 | 5 | — | — | 10 | 20 |
| $C_{12-15}$ alcohol ethoxylate (EO Avg 9) | 50 | — | — | — | — | 20 |
| $C_9$ alkyl phenol (ethoxylated (EO Avg 6) | — | 2 | 10 | 100 | 10 | — |
| Mg $(OH)_2$ to pH shown | 7.0 | 7.1 | 7.5 | — | 7.7 | 8.1 |

*Polyamines A–F used in Examples IV–IX have the general formulae disclosed hereinbefore and are as follows:

Ax=2; y=2; R=ethylene; alkoxy=ethoxy
Bx=20; y=30; R=propylene; alkoxy=propoxy
Cx=3; y=15; R=ethylene; alkoxy=ethoxy; R'=butyl
Dx=5; y=9; R=butylene; aloxy=butoxy
Ex=20; y=10; R=hexylene; aloxy=ethoxy; R': dodecyl
Fx=3; y=20; R=ethylene; alkoxy=ethoxy; R'=eicosyl

HEAVY-DUTY LIQUID DETERGENTS

Having thus described a variety of compositions in accordance with the invention, special attention is now directed to highly preferred formulations which are particularly useful as heavy duty liquid detergents that are suitable for laundering all manner of fabrics in a typical home laundering operation. The heavy duty liquid detergents disclosed hereinafter are formulated with a variety of detersive ingredients to provide excellent cleaning of a wide variety soils and stains, and wherein the solvent/polyamine contributes significantly to the removal of clay/grease and dirty motor oil stains from fabrics.

It is to be understood that, while such formulations can be prepared as water-in-oil emulsions, they are preferably prepared in the form of oil-in-water emulsions (wherein the solvent is considered the "oil" phase) and are most preferably in the form of substantially clear, homogeneous oil-in-water microemulsions. The formulator of heavy duty liquid detergents will appreciate that using water as the carrier phase in such compositions is a significant cost saving, and will further appreciate that an aqueous carrier phase contributes importantly to ease-of-formulation, since water-soluble detersive ingredients can be more readily incorporated into oil-in-water emulsions than in water-in-oil emulsions. Surprisingly, when used in a pre-treatment mode, the oil-in-water emulsions herein are comparable in grease-cutting performance to water-in-oil emulsions, which have much higher concentrations of solvent. The compositions herein with high concentrations of surfactant and fatty acid/soap may be packaged in high density polyethylene bottles without solvent loss.

EXAMPLE X

A heavy-duty liquid detergent in the form of a clear, homogeneous oil-in-water emulsion which shows excellent performance with a wide variety of clay soil types of stain is prepared as follows:

| INGREDIENT | PARTS BY WEIGHT |
|---|---|
| Polyamine (x = 5; y = 15) | 1.5 |
| Ethanol | 3.0 |
| Potassium hydroxide (50% in water) | 8.0 |
| Alkyl ($C_{11.8}$) benzene sulphonic acid | 11.0 |
| Alkyl ($C_{14/15}$) ethoxylate (EO7) | 15.0 |
| Potassium citrate monhydrate (63,5% in water) | 2.4 |
| Dequest* 2060 S (TM) | 1.2 |
| Sodium formate (40% in water) | 2.5 |
| $Ca^{++}$ as $CaCl_2$ $6H_2O$ | 60 ppm |
| Orange Terpenes | 10.0 |
| Lauric/myristic acid (60/40) | 12.5 |
| Oleic acid | 2.5 |
| Maxatase** (TM) enzyme | 0.71 |
| Termamyl*** (TM) enzyme | 0.10 |
| Optical brightener (anionic) | 0.23 |
| Perfume | 0.5 |
| Dye | 20 ppm |
| Water | to 100 |
| Product pH | 7.3 |

*Diethylene triamine pentamethylene phosphonic acid (Monsanto)
**KNGS, supplier
***NOVO, supplier The above composition is prepared by blending the indicated ingredients to provide a clear, stable microemulsion. In laundry tests, particularly with a pre-treatment step, the composition gives excellent performance on a wide variety of stains, including cosmetics amd dirty motor oil.

Preferred compositions of the foregoing microemulsion type will generally contain 10–20% of the fatty acid mix and be formulated at pH 6.6–7.3.

EXAMPLE XI

The compositon of Example X is modified slightly by using 0.6 parts by weight of magnesium hydroxide in place of 1.2 parts of potassium hydroxide (50%) to adjust pH to 7.0. The resulting product is a homogeneous microemulsion.

EXAMPLE XII

The composition of Examples X and XI are modified by replacing the orange terpene by a mixture of deodorized paraffin oil (iso-$C_{10}$–$C_{12}$) (7.5% of the total composition) and orange terpenes (2.5% of the total composition). This change in the solvent component in no way detracts from the performance attributes of the compositions, but allows the perfumer more latitude for introducing non-citrus perfume notes. Anionic optical brightener (0.01–0.5%) may be added, as desired.

SOLVENT SELECTION

As disclosed hereinabove, final selection of the solvent system for use in the present compositions will be dependant upon soil type and load, aesthetics (odour) etc. However, a number of criteria can be used to guide this selection. For example, the solvent should be substantially water immiscible; and, it should of course be capable of solubilizing a broad range of problem greasy soils. In this latter respect thermodynamic solubility parameters (Hansen Parameters) are useful in making the solvent selection.

Any solvent can be described by the Hansen Parameters $\delta_d$, $\delta_p$, $\delta_h$: $\delta_d$ being the dispersion component; $\delta_p$ the polarity component; and $\delta_h$ the hydrogen bonding component. Likewise, key greasy problem soils can be described by "pseudo" Hansen Parameters. In order to do this the solubility of each greasy stain in a broad range of solvents of different Hansen Parameters is first assessed. This can be done by immersing the greasy stain on a range of different fabric types (cotton, polyester cotton, acrylic) in each solvent in turn for a fixed time (say, 5 minutes) under fixed agitation. On removal, excess solvent is drained-off and the stained fabric is washed for 5 minutes in cool water containing 1% concentration of a typical liquid laundry detergent. Following final rinsing in cold water and drying, the stain removal can be assessed visually or by any other suitable technique. By proceeding in this way, those solvents giving best removal of each problem greasy stain can be identified, and thereby the range of each Hansen Parameter required for optimum removal of that particular stain can be assessed. Thus, for each stain a map of Hansen Parameters can be developed, and solvent/solvent combinations can be selected on this basis to give the target performance profile.

Although not intended to be limiting of the present invention, the above technique indicates that mixed solvent/solvent compositions with Hansen Parameters in the range $\delta_d$ (7 to 9), $\delta_p$ (0 to 4), $\delta_h$ (0 to 7) allow the formulation of microemulsions with superior greasy stain removal performance. The solvent combination can be targeted against particular greasy stains, such as motor oil, where the optimum Hansen Parameter range is $\delta_d$ (7 to 9), $\delta_h$ (0 to 4) $\delta_p$ (0 to 3) or marker ink, where the optimum range is $\delta_d$ (769), $\delta_h$ (2 to 11), $\delta_p$ (2 to 7), or targeted more broadly against mixed stains by selecting an intermediate point in the range of Hansen Parameters.

Some preferred solvents and solvent mixtures herein, especially: orange terpenes (d-limonene), paraffins (especially iso-$C_{10}$–$C_{12}$); cyclohexane; kerosene; orange terpene/benzyl alcohol; (60/40), n-paraffins ($C_{12-15}$)-/hexanol (50/50), fall within the Hansen Parameters, as stated.

These solvents and solvent mixtures are typically used at concentrations of 5–20%, preferably 5–10%, in the present compositions. Slightly polar solvents such as benzyl alcohol or n-hexanol can be used with water-immiscible solvents such as terpenes and paraffin oil at levels of 0–10%. Various other solvent mixtures are disclosed in Example XIX, hereinafter. As can be seen from the foregoing, the present invention encompasses a variety of formulations in the form of stable, solvent-containing emulsions. A superior heavy duty liquid detergent composition can also be prepared using a solvent system comprising diethyl phthalate (preferred) or dibutyl phthalate in combination with the terpenes (preferably, orange terpene) or dipentene, or paraffin oils, or (most preferably) mixtures thereof. The following is a representative example of such a composition. cl

EXAMPLE XIII

| Ingredient | Parts by weight |
|---|---|
| Polyamine (x = 5; y = 15) | 1.5 |
| Potassium Hydroxide (50% Aq.) | 8.0 |
| Ethanol | 3.0 |
| $C_{11.8}$ Alkyl Benzene Sulphonic Acid | 11.0 |
| $C_{14/15}$ Alkyl Ethoxylate (EO7) | 15.0 |
| Potassium Citrate (63.5 Aq.) | 2.4 |
| Deodorized Paraffin Oil* | 7.5 |
| Orange Terpene | 2.5 |
| Dibutyl phthalate | 3.0 |
| Lauric/Myristic Acids (60/40) | 12.5 |
| Enzymes (per Ex. X) | 1.0 |
| Water and minors with pH adjusted with cyclohexyl amine to 6.9 | to 100 |

*$C_{10}$–$C_{12}$ Iso-paraffins

In Example XIII, the dibutyl phthalate can be replaced by an equivalent amount of diethyl phthalate.

It will be appreciated that many of the foregoing compositions comprising the terpene hydrocarbons will necessarily have a rather strong citrus odor that may not be entirely acceptable to all formulators of such compositions. It has now been discovered that the $C_6$–$C_9$ alkyl aromatic solvents, especially the $C_6$–$C_9$ alkyl benzenes, preferably octyl benzene, exhibit excellent grease-removal properties and have a low, pleasant odor. Likewise, the olefin solvents having a boiling point of at least about 100° C., especially alpha-olefins, preferably 1-decene or 1-dodecene, are excellent grease-removal solvents.

The combination of the aforesaid alkyl-aromatic or olefin solvents with polar liquids such as benzyl alcohol, n-hexanol, Butyl Carbitol (Trade Mark; 2-(2-butoxyethoxy)ethanol) or the phthalic acid esters constitute additional examples of preferred non-polar/polar solvents that are preferred for use in the practice of this invention.

The following additional examples further illustrate oil-in-water microemulsions. In Example XVII, the use of the quaternary ammonium compound to adjust the pH of the formulation to a pH just barely below neutrality contributes importantly to product performance while maintaining long-term microemulsion stability.

EXAMPLE XIV

| Ingredient | % By Weight |
|---|---|
| $C_{11.8}$ Alkyl benzene sulphonic acid | 10.0 |
| $C_{14/15}$ Alkyl ethoxylate (EO7) | 10.9 |
| Coconut fatty acid (broad cut) | 18.2 |
| Oleic acid | 2.3 |
| Monomethyl ethanolamine | 5.8 |
| 1-Decene | 9.1 |
| Ethanol (95%) | 2.7 |
| Dequest (50%)[1] | 1.09 |
| Formic acid | 0.18 |
| $K_3$ citrate. $H_2O$ (63.5% in $H_2O$) | 4.4 |
| $CaCl_2$. $2H_2O$ | 0.05 |
| Maxatase enzyme (protease) | 0.73 |
| Termamyl enzyme (amylase) | 0.10 |
| Ethoxylated polyamine[2] | 1.73 |
| Perfume/optional brightener/dye | 0.5 |
| Water | Balance |
| Product pH | 6.6 |

[1]Diethylene triamine pentamethylenephosphonic acid
[2]Tetraethylene pentamine 105 EO units/molecule The composition of Example XIV is a stable, oil-in-water microemulsion suitable for use as a laundry detergent.

EXAMPLE XV

The composition of Example XIV is modified by replacing the 1-Decene by the same amount (9.1% total formulation) of n-octyl benzene. Product pH "as is": 6.6.

EXAMPLE XVI

The composition of Example XV is modified by replacing the 1-Decene by any of the following solvent mixtures (percentages of total formulation being specified in parentheses): 1-Decene (6.1%)/Diethylphthalate (3.0%); 1-Dodecene (5.9%)/Benzyl alcohol (3.2%); n-octyl benzene (6.2%)/Diethyl phthalate (2.9%); n-octyl benzene (5.0% )/Butyl carbitol (4.1%); Diethyl phthalate (6%)/liquid $C_{10}$ iso-paraffin (2%)/orange terpene (2%). Product pH's as is: 6.6.

EXAMPLE XVII

The compositions of Examples XIV, XV, and XVI are modified by adding sufficient cyclohexyl amine or dioctyldimethyl ammonium chloride to adjust the "as is" pH of the compositions from 6.6 to 6.94. The resulting compositions exhibit exceptionally good fabric cleaning and whiteness maintenance.

EXAMPLE XVIII

An extra-heavy duty laundry additive composition is as follows.

| Ingredient | Percent by Weight |
|---|---|
| 1-Decene | 20 |
| n-Octyl benzene | 10 |
| Diethyl phthalate | 10 |
| Polyamine (x = 5 y = 15) | 10 |
| Sodium tripolyphosphate | to 100. |

Another preferred olefin solvent herein by virtue of its relatively low odor is the so-called "P-4" polymer, available from a number of petrochemical suppliers to the detergent industry as a raw material for branched alkyl benzene. P-4 is an isomer mix of the condensation product of 4-moles of propylene, i.e. $C_{12}$ branched olefins. P-4 is non-polar, and is preferably used in combination with a polar solvent such as benzyl alcohol, diethylphthalate, Butyl Carbitol, or the like.

Other useful polar solvents herein include the "cellosolves" e.g. alkoxy alkanols such as 2-butoxyethanol; $C_6$–$C_{12}$ alkanols (including benzyl alcohol) such as dodecanol, phenethyl alcohol, diglycolether acetates, hexyl cellosolve and hexyl carbitol, and the like.

EXAMPLE XIX

The following are additional examples of grease-removal solvent mixtures which can be used with the alkoxylated polyamines in the manner of this invention.

| Composition | Ingredient | Percent |
|---|---|---|
| A | Octyl benzene | 70% |
| | Diethyl phthalate | 30% |
| B | 1-Decene | 70% |
| | Diethyl phthalate | 30% |
| C | Octyl benzene | 80% |
| | Benzyl alcohol | 20% |
| D | n-Octyl benzene | 90% |
| | Butyl carbitol | 10% |
| E | 1-Decene | 65% |

-continued

| Composition | Ingredient | Percent |
|---|---|---|
| | Dibutyl phthalate | 35% |
| F | n-Octyl benzene | 30% |
| | 1-Decene | 40% |
| | Benzyl alcohol | 10% |
| | Butyl carbitol | 20% |
| G | 1-Decene | 80% |
| | n-Hexanol | 20% |
| H | 1-Decene | 60% |
| | Diethyl phthalate | 40% |
| I | 1-Dodecene | 80% |
| | Hexyl cellosolve | 20% |
| J | Mixed 1:1 nonyl/hexyl benzene | 35% |
| | 2-Dodecene | 35% |
| | Dimethyl phthalate | 30% |

In a preferred method of use aspect, the compositions herein are used in an aqueous laundering liquor at a liquor pH of 6.5–8.0 (measured as 1% of composition in water) to launder fabrics. Excellent cleaning is attained by agitating fabrics in such liquors at this in-use pH range.

Nitrogen-functional Stabilizers/pH Regulants—As disclosed in Examples XIII and XVII, above, various alkyl and cyclo-alkyl amines, quaternary ammonium compounds, as well as amine oxides, constitute a highly preferred class of pH regulants and stabilizers in the oil-in-water microemulsion detergent compositions of the present type. Apparently, such materials may somehow associate with the fatty acid or anionic surfactants to form a complex which stabilizes the microemulsified oil (solvent). While the nitrogen functional compounds do not boost the pH very much towards the alkaline range (only several tenths of a pH unit, measured on the product formulated "as is") the resulting boost in detergency performance, especially enzymatic cleaning performance, is substantial.

Parenthetically, it is to be understood that with regard to pH adjustments in the compositions up to about pH 6.5–6.6, any of the well-known base materials can be used, for example, triethanolamine, alkali metal hydroxide and the like. Potassium hydroxide is preferred over sodium hydroxide, inasmuch as the ease of formulation of stable systems is increased substantially by the potassium cation.

Dioctyl dimethyl ammonium chloride is a highly preferred quaternary used herein as a pH-regulant, but there can also be mentioned the following quaternaries in increasing order of preference of use: coconut trimethyl ammonium chloride (6.66); di-coconut dimethyl ammonium chloride (6.84); coconut benzyl dimethyl ammonium chloride (6.84); and dihexyl dimethyl ammonium chloride (6.89). The numbers in parentheses denote the pH achievable by adding the respective quaternaries to a liquid oil-in-water microemulsion containing fatty acid and formulated at an "as is" pH of 6.5. For the preferred dioctyl dimethyl ammonium chloride, the pH figure is 6.94.

Suitable alkyl and cyclo-alkyl amines useful herein (with attendant pH's) include: coconutalkyl diethanol amine (6.65); coconutalkyl dimethyl amine (6.75); trioctyl amine (7.0); and cyclohexyl amine (7.5).

Suitable amine oxides herein include coconutalkyl dimethylamine oxide (6.7) and dioctyl methylamine oxide (est. 7).

It is to be understood that the foregoing nitrogen compounds can be added to the compositions until the desired pH is obtained. To achieve the pH listed, from 0.5% to 5% of the compounds are typically used in the compositions. Cyclohexyl amine (1–5%) is most preferred for use herein.

In general terms, the most highly preferred oil-in-water microemulsion form of the compositions herein comprise:

a. 10% to 70% water (carrier); p1 b. 5% to 20% grease removal solvent or solvent mixture;
c. 5% to 35% fatty acid or fatty acid/soap mixture;
d. 1% to 40% detersive surfactant;
e. 0.001% to 2% detersive enzyme;
f. at least 0.2% alkoxylated polyamine; and
g. said composition being adjusted to a pH (undiluted) of 6.6–7.5 using a nitrogenous material (as described) especially cyclohexylamine.

Microemulsion stability of such composition can be estimated visually by watching for phase separation, or can be monitored quantitatively by standard turbidometric techniques. Product "as is" pH is measured at ambient (23° C.) temperature using a commercial pH meter. The electrode is immersed in the product and the meter is allowed to stabilize before reading.

EXAMPLE XX

A highly preferred liquid laundry detergent by virtue of the low odor properties of its grease removal solvent system, its stability in microemulsion form, and its enzymatic cleaning activity (by virtue of its pH) is as follows.

| Ingredient | Parts by Weight |
|---|---|
| Alkyl($C_{11,8}$)benzene sulfonic acid | 11.0 |
| Alkyl($C_{14/15}$)ethoxylate (EO7) | 12.0 |
| Topped whole cut coconut fatty acid (1) | 20.5 |
| $C_{10-11}$ isoparaffins | 4.0 |
| Diethyl phthalate | 6.0 |
| Cyclohexylamine | 2.0 |
| Monomethyl ethanolamine (2) | 4.3 |
| Potassium citrate monohydrate (63.5% in water) | 2.4 |
| Dequest 2060 S | 1.7 |
| Ethoxylated polyamine (x = 5, y = 15) | 1.5 |
| Ethanol | 3.0 |
| Potassium hydroxide (50% in water) (2) | 3.0 |
| Formic acid | 0.2 |
| $CaCl_2$ $2H_2O$ | 0.05 |
| Optical brightener (anionic) | 0.18 |
| Maxatase enzyme (3) | 0.71 |
| Termamyl 300 L enzyme (4) | 0.10 |
| Dye | 20 ppm |
| Perfume | 0.5 |
| Water | up to 110 parts |
| Product pH | 6.9 |

(1) Chain length mixture: $C_{10}$(5%) $C_{12}$(55%) $C_{14}$(22%) $C_{18}$(2%) oleic(10%)
(2) To adjust pH to 6.6
(3) From KNGS
(4) From NOVO The composition of Example XX is used in an aqueous laundry bath at a concentration of 100 ml/10 liters and provides an in-use pH of about 7,2 (varies with water hardness).

What is claimed is:

1. A stain removal composition, comprising:
a. a grease-removal organic solvent; and
b. an alkoxylated polyamine of the formula:

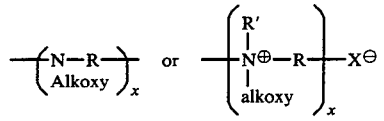

wherein R is hydrocarbyl having from 2 to 6 carbon atoms, R′ is $C_1$ to $C_{20}$ hydrocarbon, alkoxy is selected from polyethoxy, polypropoxy, polybutoxy or mixtures thereof, having a degree of polymerization of 2–30, x is an integer of at least 2 and $X^{\theta}$ is an anion wherein the weight ratio of the solvent:alkoxylated polyamine is in the range of 100:1 to 1:20.

2. A composition according to claim 1 wherein the alkoxylated polyamine is the polymerized reaction product of ethylene oxide with ethylene imine.

3. A composition according to claim 2 wherein the alkoxylated polyamine is of the formula:

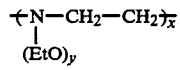

wherein x is an integer from 3 to 5 and y is an integer from 10 to 20.

4. A composition according to claim 1 which contains at least 5% of the mixture of solvent and alkoxylated polyamine.

5. A detergent composition comprising conventional detersive ingredients, comprising at least 5% of grease-removal solvent and at least 0.2% alkoxylated polyamine of the formula:

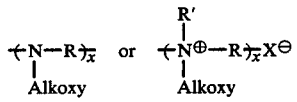

wherein R is hydrocarbyl, R′ is $C_1$ to $C_{20}$ hydrocarbon, x is an integer of at least 2 and $X^{\ominus}$ is an anion.

6. A detergent composition according to claim 5 wherein the alkoxylated polyamine is the polymerized reaction product of ethylene oxide with ethylene imine.

7. A composition according to claim 1 which is in the form of an oil-in-water microemulsion.

8. A composition according to claim 7 which additionally contains from 0.5% to 50% of fatty acid or soap.

9. A composition according to claim 8 wherein the solvent is selected from terpenes, paraffin oil, $C_6$–$C_9$ alkyl benzenes, liquid olefins and mixtures thereof.

10. A composition according to claim 9 wherein the solvent is selected from a mixture of:
(a) terpenes, iso-paraffins, $C_6$–$C_9$ alkyl benzenes or liquid olefins; and
(b) benzyl alcohol, diethylphthalate, dibutylphthalate or 2-(2-butoxyethoxy)ethanol
at a weight ratio (a):(b) of 1:10 to 10:1.

11. A method of laundering fabrics by agitating said fabrics in an aqueous liquor containing a composition according to claim 1.

* * * * *